US010066846B2

(12) United States Patent
Kim

(10) Patent No.: US 10,066,846 B2
(45) Date of Patent: Sep. 4, 2018

(54) FLOATING TYPE HUMIDIFIER

(71) Applicant: MIRO CO. LTD., Incheon (KR)

(72) Inventor: Min Seok Kim, Incheon (KR)

(73) Assignee: MIRO CO. LTD., Incheon (KR)

( * ) Notice: Subject to any disclaimer, the term of this patent is extended or adjusted under 35 U.S.C. 154(b) by 0 days.

(21) Appl. No.: 15/125,506

(22) PCT Filed: Mar. 9, 2015

(86) PCT No.: PCT/KR2015/002261
§ 371 (c)(1),
(2) Date: Sep. 12, 2016

(87) PCT Pub. No.: WO2015/137677
PCT Pub. Date: Sep. 17, 2015

(65) Prior Publication Data

US 2017/0089596 A1 Mar. 30, 2017

(30) Foreign Application Priority Data

Mar. 10, 2014 (KR) ..... 10-2014-0027986

(51) Int. Cl.
*B01F 3/04* (2006.01)
*F24F 6/12* (2006.01)
(Continued)

(52) U.S. Cl.
CPC ..... *F24F 6/12* (2013.01); *B01F 3/0407* (2013.01); *F24F 6/14* (2013.01); *F24F 6/16* (2013.01);
(Continued)

(58) Field of Classification Search
CPC ... B01F 3/0407; B01F 2215/0091; F24F 6/12; F24F 6/14; F24F 6/16; F24F 2006/008
(Continued)

(56) References Cited

U.S. PATENT DOCUMENTS 423,257 A * 3/1890 Huber ..... B01F 13/0049 261/120
2,840,682 A * 6/1958 Rubenstein ..... F24H 1/00 392/337
(Continued)

FOREIGN PATENT DOCUMENTS

KR 10-1989-0000321 A 3/1989
KR 10-2001-0090320 A 10/2001
(Continued)

*Primary Examiner* — Charles Bushey
(74) *Attorney, Agent, or Firm* — Novick, Kim & Lee, PLLC; Sang Ho Lee

(57) ABSTRACT

Provided is a floating type humidifier, and particularly, a floating type humidifier which can prevent, when a floating type humidifier discharging water particles or vapor while floating on water in a water tank loses a balance thereof and falls, the water stored in the water tank from flushing abruptly and even though a water tank falls due to external force such as an earthquake or carelessness of a user, water stored in the water tank is prevented from being abruptly discharged to minimize a cleaning operation which occurs as much water is discharged, the floating type humidifier can prevent foreign materials from being input in the water stored in the water tank, and the floating type humidifier can be stably used even at places including a hospital, a kindergarten, and a home where a lot of children move.

11 Claims, 9 Drawing Sheets

(51) Int. Cl.
*F24F 6/16* (2006.01)
*F24F 6/14* (2006.01)
*F24F 6/00* (2006.01)

(52) U.S. Cl.
CPC . *B01F 2215/0091* (2013.01); *F24F 2006/008* (2013.01)

(58) Field of Classification Search
USPC ..... 261/30, 81, 119.1, 120, DIG. 65
See application file for complete search history.

(56) References Cited

U.S. PATENT DOCUMENTS 3,864,437 A * 2/1975 Blaszkowski ..... F24F 6/04 261/120
5,673,360 A * 9/1997 Scripps ..... F24F 6/025 220/8
5,940,578 A * 8/1999 Goddard ..... B01D 1/0005 392/337
6,592,107 B1 * 7/2003 Wong ..... F24F 6/02 261/107
9,377,208 B2 * 6/2016 Seo ..... B05B 17/0623
2017/0074532 A1 * 3/2017 Kim ..... F24F 6/00
2017/0304861 A1 * 10/2017 Seo ..... B05B 17/0646

FOREIGN PATENT DOCUMENTS

KR 10-2011-0066067 A 6/2011
KR 10-2011-0131684 A 12/2011
KR 10-1268866 B1 5/2013
KR 10-1374967 B1 3/2014

* cited by examiner (A)

(B)

FLOATING TYPE HUMIDIFIER

BACKGROUND

Field

The present disclosure relates to a floating type humidifier, and particularly, to a floating type humidifier which can prevent, when a floating type humidifier discharging water particles or vapor while floating on water in a water tank loses a balance thereof and falls due to external shock, and the like, the water stored in the water tank from flushing.

Description of the Related Art

In general, a humidifier is an apparatus that provides moisture to a dry room.

The humidifier can be classified into an ultrasonic humidifier using ultrasonic waves and a heating humidifier using a heater according to a humidification mode.

In the former case, water stored in a water tank attached to/detached from a body is supplied to the water tank and the water in the water tank is changed into minute water drops by vibration of an ultrasonic vibrator provided in the water tank to be sprayed through a spray nozzle in a nebulization state together with air by actuating a blow fan.

Contrary to this, in the latter case, the water supplied onto the water tank is vaporized by preheating of the heater to be sprayed through the spray nozzle in the nebulization state together with the air by the blow fan as described above.

The ultrasonic humidifier and the heating humidifier are just different from each other in that the water in the water tank is generated into the minute water drops or vapor by an ultrasonic oscillator or the heater and can be similarly configured in terms of other structures.

In the case of two types of humidifiers, proliferation of bacteria and a washing problem are emphasized as a big disadvantage and in order to resolve the problem, a natural type humidifier which is comparatively convenient to manage, such as washing is generally used.

In addition, among the natural type humidifiers, a floating type humidifier which is comparatively convenient to manage such as the washing is generally used.

The floating type humidifier is a type in which the water in the water tank is changed to the minute water particles by the vibration of the ultrasonic vibrator to be discharged to the outside while floating on the surface of the water stored in the water tank and is a mode to drive the ultrasonic vibrator by supplying power using a battery or a mode to supply the power to the ultrasonic vibrator in connection with an external power supply by an electric wire.

However, since the floating type humidifier in the related art has a structure in which the top of the water tank storing the water is opened, the water tank falls down due to user's carelessness, and as a result, the water in the water tank flushes.

In particular, since there are a lot of cases in which the humidifier is used for children having weak immune systems, the water tank of the floating type humidifier frequently loses a balance thereof and falls down due to children's carelessness at a place such as a children's hospital, a kindergarten, a home where children are brought up.

Further, the floating type humidifier cannot but be limitatively used due to the problems in a country such as Japan where an earthquake frequently occurs.

In addition, when dust or other foreign materials are input and immersed in the water tank, the floating type humidifier cannot also perform a natural function and a natural role.

Accordingly, the present applicant has developed a floating type humidifier according to the present disclosure in order to solve the problems and as a reference prior art document, 'Humidifier Using the Outer Water Storage' of Korean Patent Unexamined Publication No. 10-2001-90320 is provided.

SUMMARY

An object to be achieved by the present disclosure is to provide a floating type humidifier which can prevent, when a floating type humidifier and a water tank fall due to external force, water stored in the water tank from flushing abruptly through cooperation of the floating type humidifier and a cover.

According to an aspect of the present disclosure, there is provided a floating type humidifier including: a water tank having a shape in which the top is opened; a floating body which has a water inflow hole through which water stored in the water tank flows and a space part formed therein and floats in the water stored in the water tank; a humidifier case detachably coupled to the floating body; and a floating cover covering the opened top of the water tank, having a through-hole into which the top of the humidifier case is inserted to be exposed to the outside, and inserted into the water tank to float in the water stored in the water tank.

Further, the floating cover may include a plate covering the opened top of the water tank, and a protrusion provided on the bottom of the plate, and the protrusion may float in the water stored in the water tank.

The humidifier case may have a shape in which an outer diameter gradually decreases from the bottom to the top and the top may be inserted into the through-hole with a gap.

The inner surface of the floating cover partitioning the through-hole may be rounded so as to surface-contact to correspond to the outer surface of the top of the humidifier case.

A packing member may be provided on the inner surface of the floating cover partitioning the through-hole.

A handle may be provided on the floating cover.

The protrusion of the floating cover may be made of any one of a foaming molding object which can float in the water and a rubber material.

An ultrasonic vibrator may be inserted into the water inflow hole of the floating body to generate the water which flows from the water tank as water particles or vapor.

A guide pipe that guides the water particles or vapor generated by the ultrasonic vibrator to the outside and having a guide hole formed on one side surface may be coupled to the top of the water inflow hole of the floating body.

A cap for controlling an emission amount and an emission direction of the water particles or vapor may be provided on the top of the humidifier case, and an emission hole through which the water particles or vapor is discharged may be formed at the cap.

A water injection hole may be formed on the cover and a plug may be detachably coupled to the water injection hole.

According to the present disclosure, in a floating type humidifier, even though a water tank falls due to external force such as an earthquake or carelessness of a user, water stored in the water tank is prevented from being abruptly discharged to conveniently perform a cleaning operation which occurs as much water is discharged.

Further, according to the present disclosure, the floating type humidifier can prevent foreign materials from being input in the water stored in the water tank.

In addition, according to the present disclosure, the floating type humidifier can be stably used even at places including a hospital, a kindergarten, and a home where a lot of children move.

BRIEF DESCRIPTION OF THE DRAWINGS

The above and other aspects, features and other advantages of the present disclosure will be more clearly understood from the following detailed description taken in conjunction with the accompanying drawings, in which.

DETAILED DESCRIPTION OF THE PREFERRED EMBODIMENT

Figure 1:
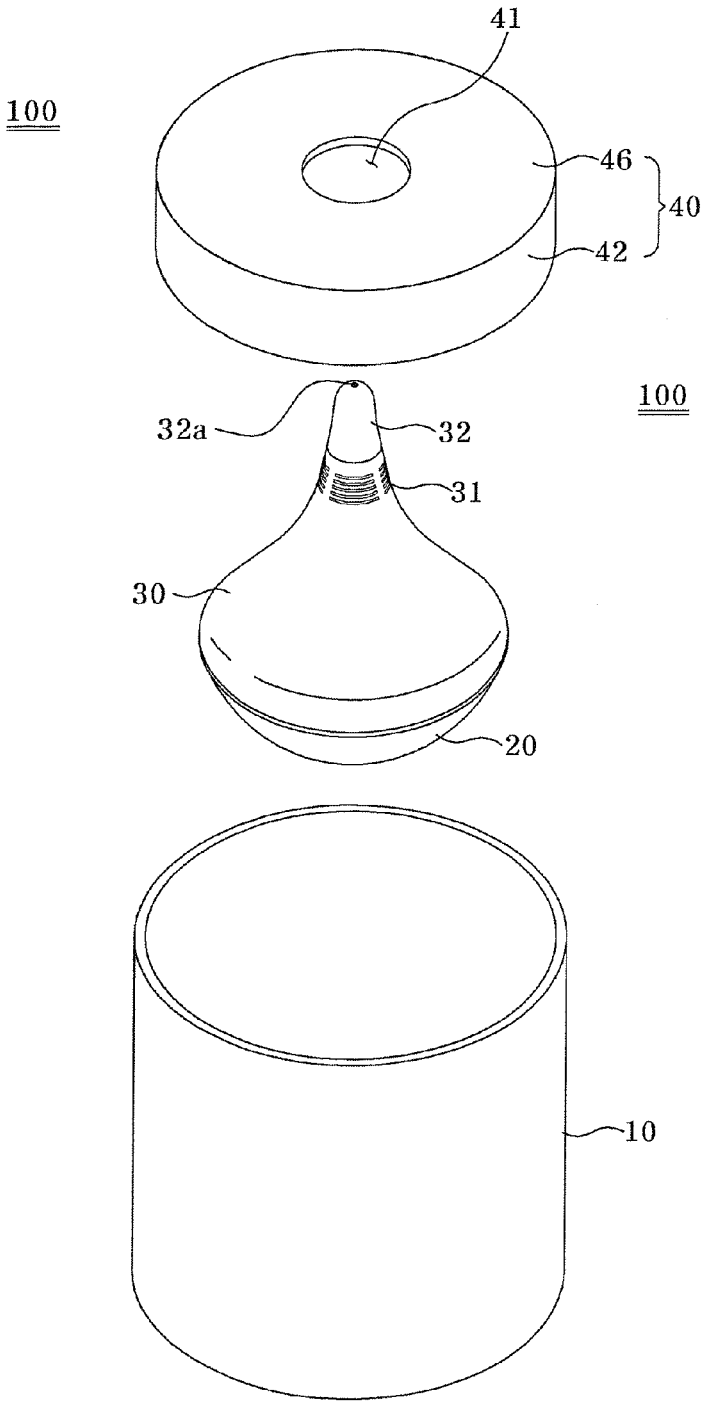
FIG. 1 is an exploded perspective view of a floating type humidifier according to an exemplary embodiment of the present disclosure.
Figure 2:
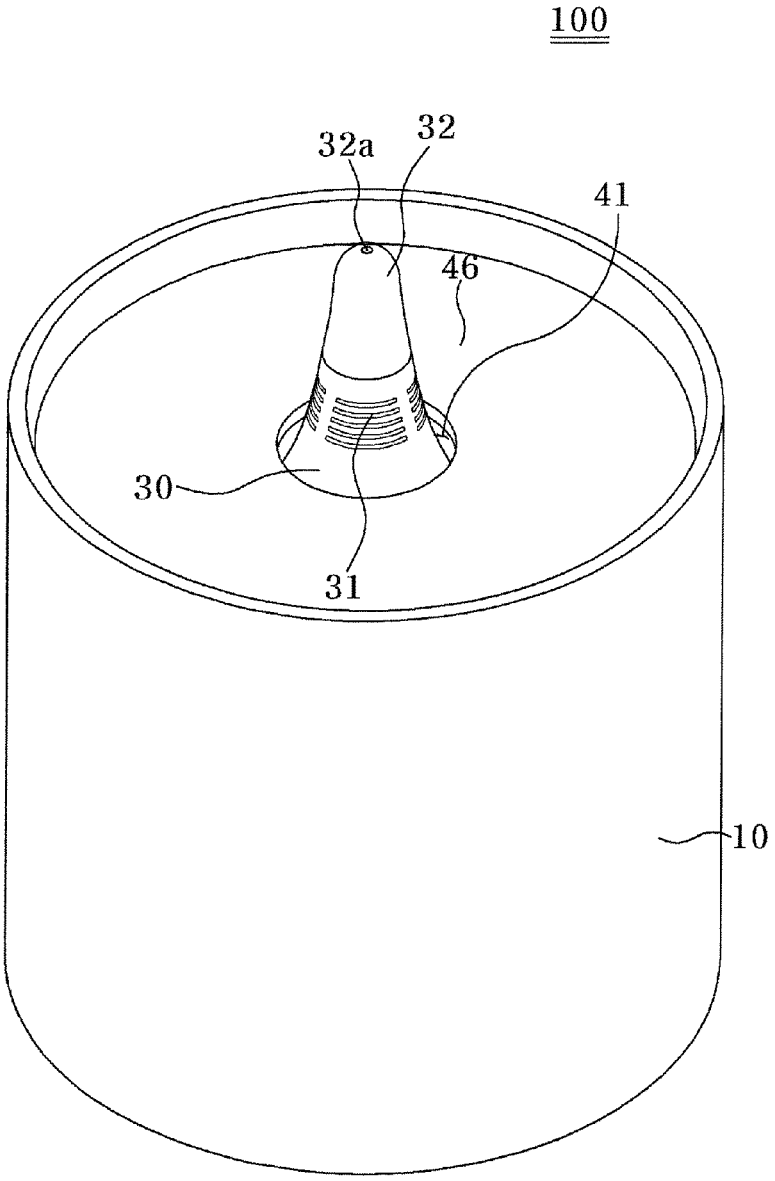
FIG. 2 is a combinational perspective view of the floating type humidifier illustrated in FIG. 1.

The advantages and features of the present disclosure and a method of accomplishing these will become obvious with reference to embodiments to be described below in detail along with the accompanying drawings.

However, the present disclosure is not limited to the exemplary embodiments set forth below, and may be embodied in various different forms. The present exemplary embodiments are just for rendering the description of the present disclosure complete and are set forth to provide a complete understanding of the scope of the disclosure to a person with ordinary skill in the technical field to which the present disclosure pertains, and the present disclosure will only be defined by the scope of the claims.

As illustrated in FIGS. 1 to 4, a floating type humidifier 100 according to an exemplary embodiment of the present disclosure may include a water tank 10 having a shape in which a top of the water tank is opened, a floating body 20 having a water inflow hole 21 (see FIG. 3) in which water stored in the water tank 10 may flow and a space part formed therein, and which floats in the water stored in the water tank 10, a humidifier case 30 detachably coupled with the floating body 20, and a floating cover 40 which having a through-hole 41 into which the top of the humidifier case is inserted and is inserted into the water tank 10 and floats in the water stored in the water tank 10.

In the water tank 10, the space part in which the top is opened and the water may be stored therein may be formed.

Figure 7:
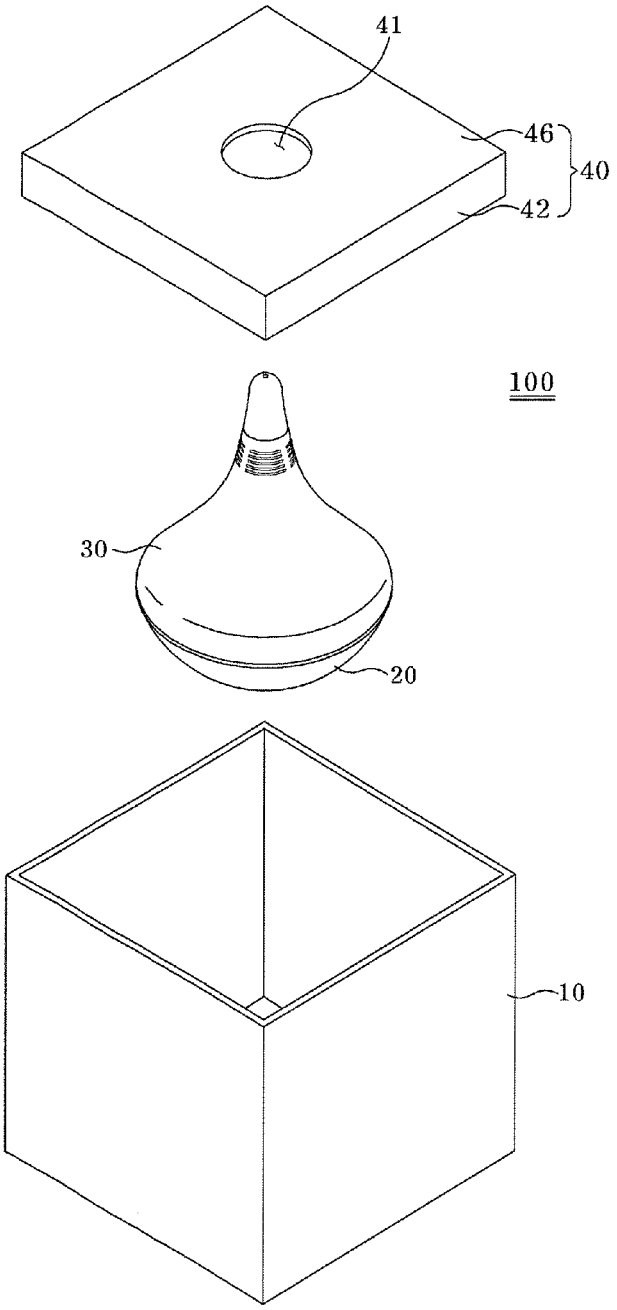
FIG. 7 is an exploded perspective view illustrating a water tank and a floating cover having a quadrangular cross section.

In addition, the water tank 10 has a cylindrical shape in the exemplary embodiment of the present disclosure, but the shape of the water tank 10 is not limited thereto. That is, as illustrated in FIG. 7, the water tank 10 may be manufactured in a quadrangular shape and may be manufactured in shapes including a triangular shape and a polygonal shape in addition to the quadrangular shape.

The floating body 20 may have a dish shape in which the space part is formed so as to float in the water stored in the water tank 10.

Figure 3:
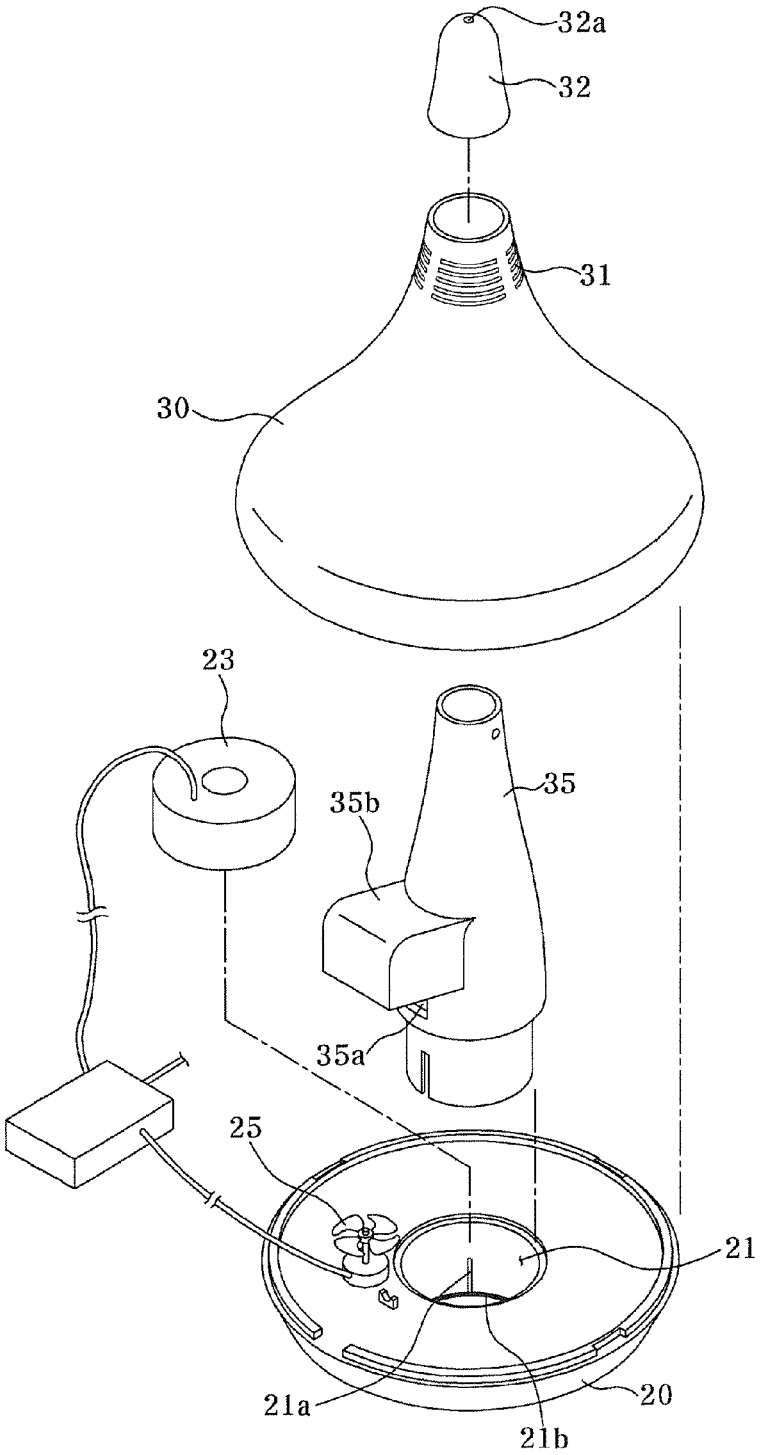
FIG. 3 is an exploded perspective view illustrating configurations of a humidifier case and a floating body according to an exemplary embodiment of the present disclosure.

Further, the floating body 20 may include an ultrasonic vibrator 23 which is inserted into the water inflow hole 21 to generate the water which flows from the water tank 10 as water particles or vapor as illustrated in FIG. 3.

In addition, a plurality of projections 21a which contacts an outer surface of the ultrasonic vibrator 23 to support the ultrasonic vibrator 23 may be formed on an inner surface of the floating body 20 partitioning the water inflow hole 21 to be spaced apart from each other.

Moreover, a rubber made packing member 21b may be provided below the inner surface of the floating body 20 partitioning the water inflow hole 21, which absorbs vibration shock generated by the ultrasonic vibrator 23.

Further, the floating body 20 may further include a discharge means 25 smoothly discharging the water particles or vapor generated by the ultrasonic vibrator 23 to the outside.

The discharge means 25 is provided on the top of the floating body 20 and in the exemplary embodiment of the present disclosure, a fan is exemplified as the discharge means 25 as illustrated in FIG. 3, but the discharge means 25 is not limited thereto and an air pump may be used.

The humidifier case 30 may be detachably coupled to the top of the floating body 20 and manufactured in a gourd bottle shape in which an outer diameter gradually decreases from the bottom to the top.

In addition, a plurality of air inflow holes 31 in which external air flows are formed on an outer surface of the top of the humidifier case 30 to be spaced apart at a predetermined interval.

Further, a cap 32 for controlling an emission amount and an emission direction of the water particles or vapor generated by the ultrasonic vibrator 23 is provided on the top of the humidifier case 30 and an emission hole 32*a* through which the water particles or vapor is discharged may be formed at the cap 32.

Portions of the humidifier case 30 where the air inflow hole 31 and the cap 32 are formed are portions exposed to the top of the floating cover 40 when the floating cover 40 is inserted into the water tank 10 and floats in the water.

In addition, the humidifier case 30 includes a guide pipe 35 guiding the water particles or vapor generated by the ultrasonic vibrator 23 to the top of the humidifier case 30 where the cap 32 is provided as illustrated in FIG. 3.

A lower end of the guide pipe 35 may be inserted into the top of the inner surface of the floating body 20 partitioning the water inflow hole 21.

In addition, a guide hole 35*a* may be formed on one side surface of the guide pipe 35.

Further, a blocking unit 35*b* having a 'ㄱ'-shaped cross section is formed on the top of the one side surface of the guide pipe 35 with the guide hole 35*a*.

The blocking unit 35*b* is provided on the top of the discharge means 25 and serves to guide air moved by the discharge means 25 to the guide hole 35*a* when the lower end of the guide pipe 35 is inserted into the water inflow hole 21.

The water stored in the water tank 10 may be discharged to the outside of the water tank 10 in a water-particle or vapor state by the humidifier case 30 and the floating body 20 having such a configuration.

The floating cover 40 has a figurative size to cover the opened top of the water tank 10 and the through-hole 41 into the top of the humidifier case 30 may be inserted is formed at the center of the floating cover 40 as described above.

In addition, the floating cover 40 includes a plate 46 covering the opened top of the water tank 10 and a protrusion 42 which is provided to protrude downwards from the periphery of the bottom of the plate.

It is illustrated that the plate 46 has a disk shape in the drawings in the exemplary embodiment of the present disclosure, but the shape of the plate 46 is not limited thereto and as illustrated in FIG. 7, the plate 46 may be manufactured in the quadrangular shape and manufactured in the triangular shape and the polygonal shape in addition to the quadrangular shape.

The through-hole 41 of the floating cover 40 has a size to have a gap of a predetermined interval from the outer surface of the humidifier case 30 when the humidifier case 30 is inserted.

The protrusion 42 is provided to protrude downwards from the periphery of the bottom of the plate 46.

In addition, the protrusion 42 may be made of foaming styrofoam as a foaming molding object which may float in the water or a rubber material.

Moreover, an outer diameter of the plate 46 is smaller than an inner diameter of the water tank 10, and as a result, the gap of the predetermined interval is formed between the inner surface of the water tank 10 and the outer surfaces of the plates 46 and the protrusion 42.

For reference, in the drawings of the specification of the present disclosure, it is illustrated that the gap is formed between the outer surface of the floating cover 40 and the inner surface of the water tank 10, but actually, a gap which is difficult to identify with human naked eyes is formed between the outer surface of the floating cover 40 and the inner surface of the water tank 10.

Figure 4:
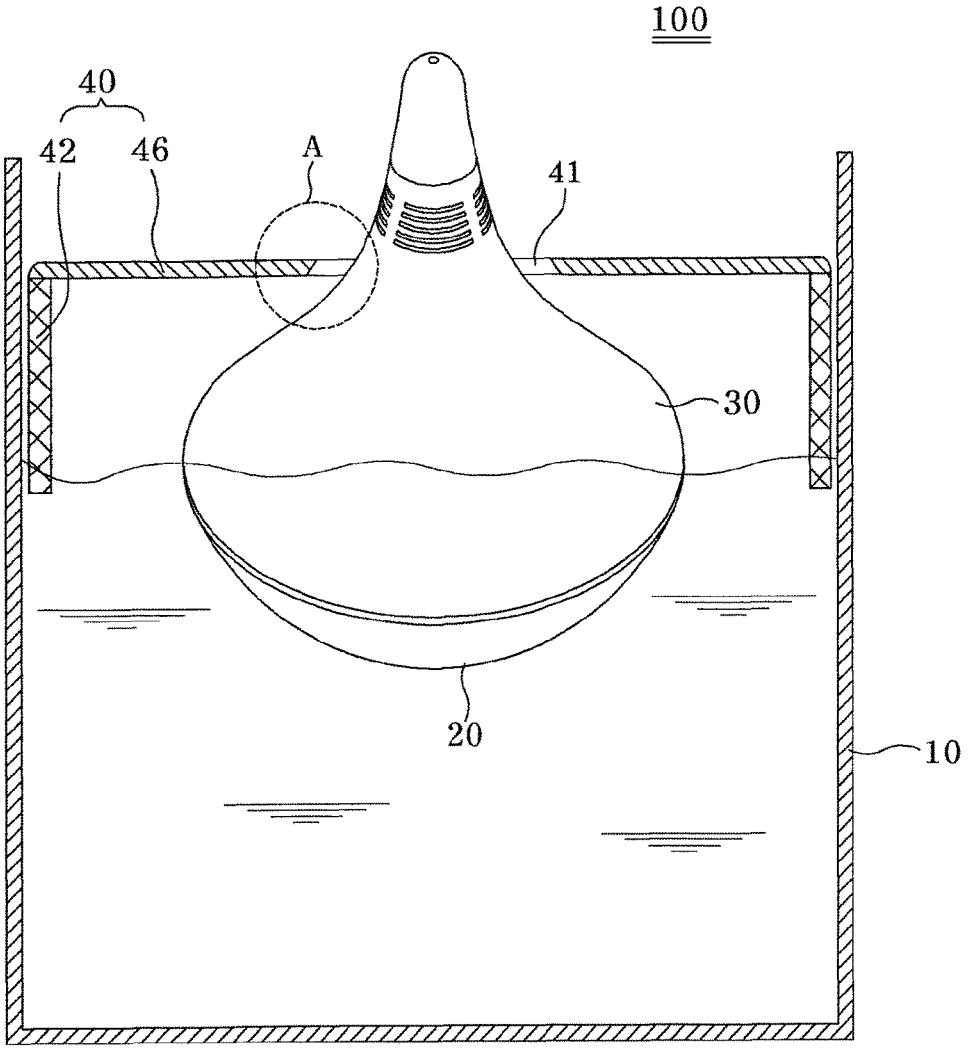
FIG. 4 is a cross-sectional view of the floating type humidifier illustrated in FIG. 2.

When the floating cover 40 having such a configuration is inserted into the water tank 10, as described in FIG. 4, the protrusion 42 of the floating cover 40 may float while a lower end of the protrusion 42 is partially immersed in the water stored in the water tank 10.

As a result, the floating cover 40 may also move vertically in the water tank 10 according to the height of the water surface of the water stored in the water tank 10.

Figure 5:
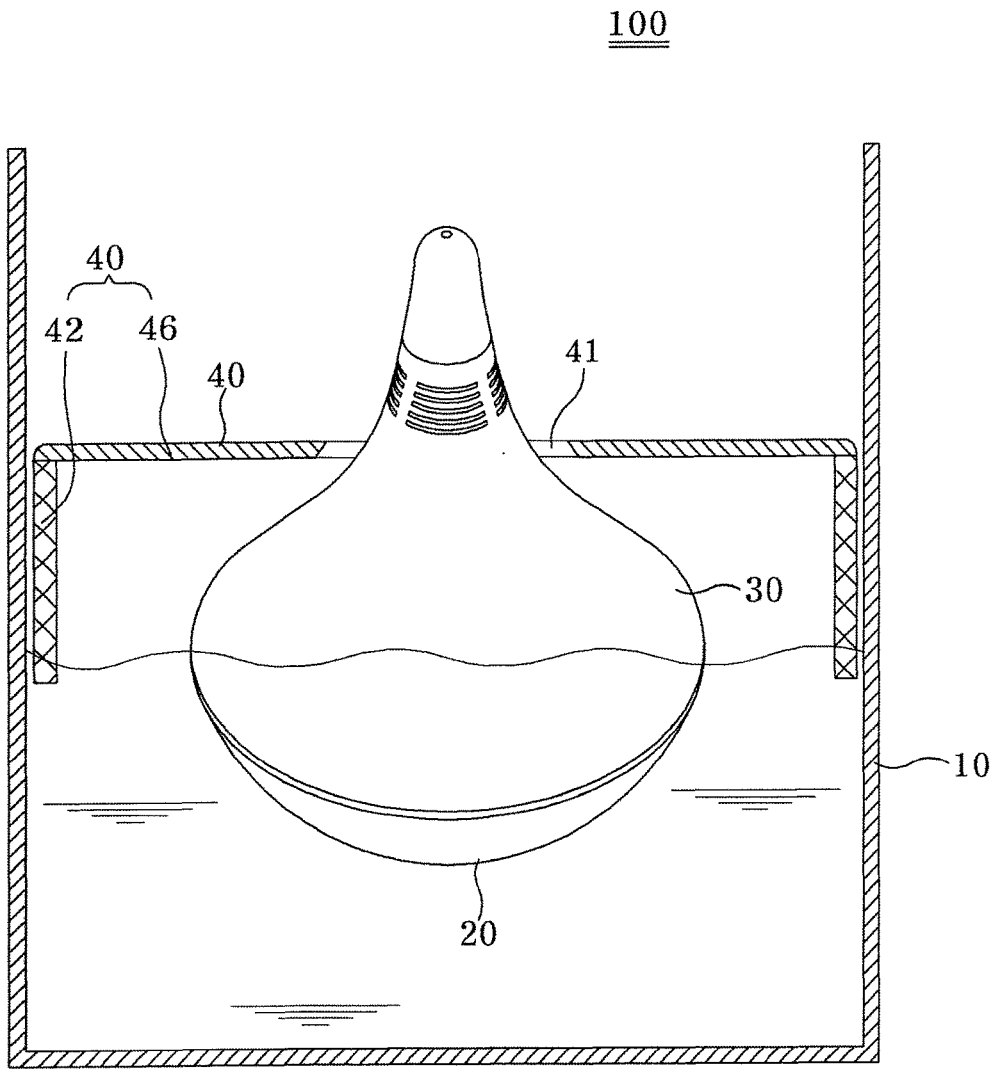
FIG. 5 is a cross-sectional view illustrating a state in which the floating body, the humidifier case, and a floating cover are moved according to a height of a water surface.

For example, when the height of the water surface of the water stored in the water tank 10 decreases, as described in FIG. 5, the floating body 20, and the humidifier case 30 and the floating cover 40 may also move downwards in the water tank 10 according to the height of the water surface of the water.

Figure 8:
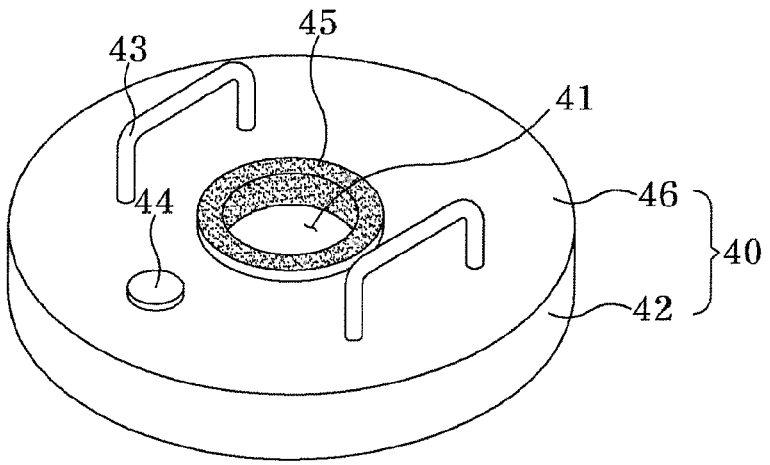
FIG. 8 is a perspective view illustrating a state in which a packing member is mounted on the floating cover according to an exemplary embodiment of the present disclosure.
Figure 8:
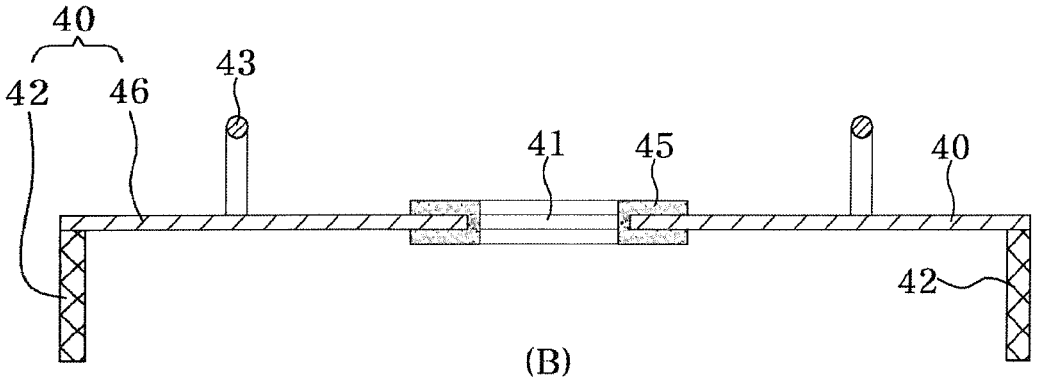

In this case, as illustrated in FIG. 8, a handle 43 is preferably provided on the plate 46 of the cover 40 so that the user easily executes an operation of inserting the floating cover 40 into the water tank 10 or extracting the floating cover 40 from the inside of the water tank 10.

In addition, as illustrated in FIG. 8, a water injection hole (not illustrated) is formed on the plate 46 of the floating cover 40 and a plug 44 may be detachably coupled to the water injection hole.

The water injection hole allows water to be poured into the water tank 10 even in the state in which the floating cover 40 is coupled to the water tank 10.

In addition, as a method in which the plug 44 is detachably coupled to the water injection hole, the known press-fit method, screw coupling method, or the like may be used.

Further, the inner surface of the floating cover 40 partitioning the through-hole 41 may be formed in a shape of a plane corresponding to the outer surface of the top of the humidifier case 30.

Figure 6:
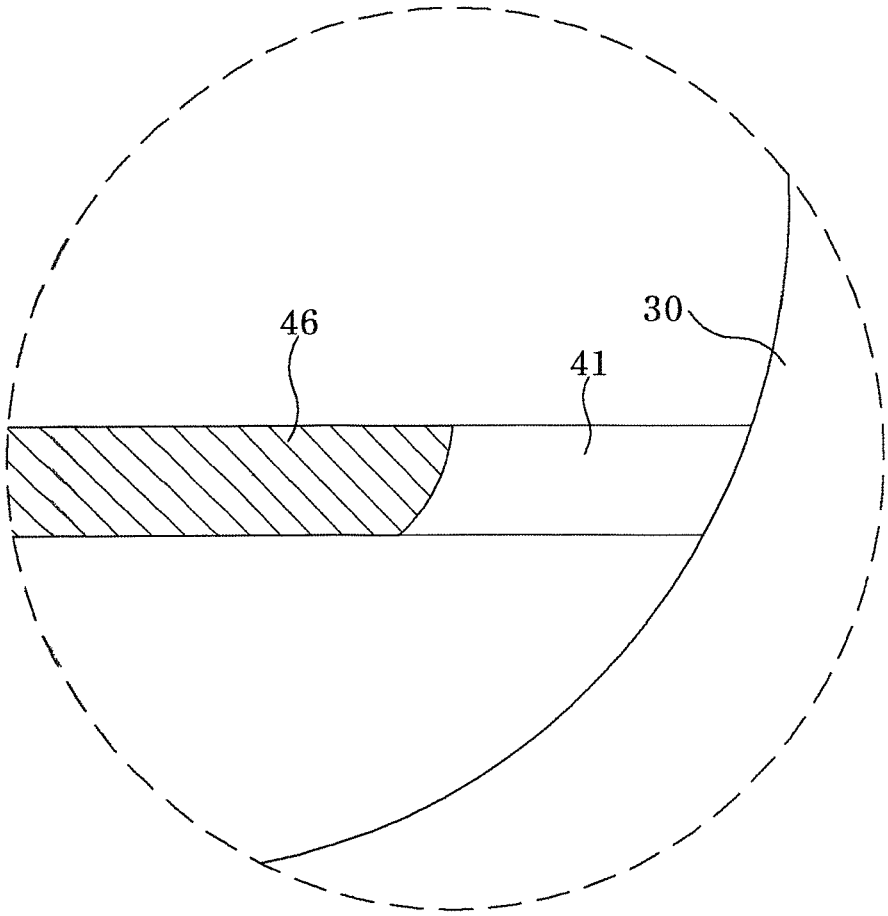
FIG. 6 is an enlarged diagram of part A illustrated in FIG. 4.

As illustrated in FIG. 6, since the humidifier case 30 according to the exemplary embodiment of the present disclosure has the gourd bottle shape, the inner surface of the floating cover 40 partitioning the through-hole 41 is preferably rounded in an arc shape so as to surface-contact the humidifier case 30.

Figure 9:
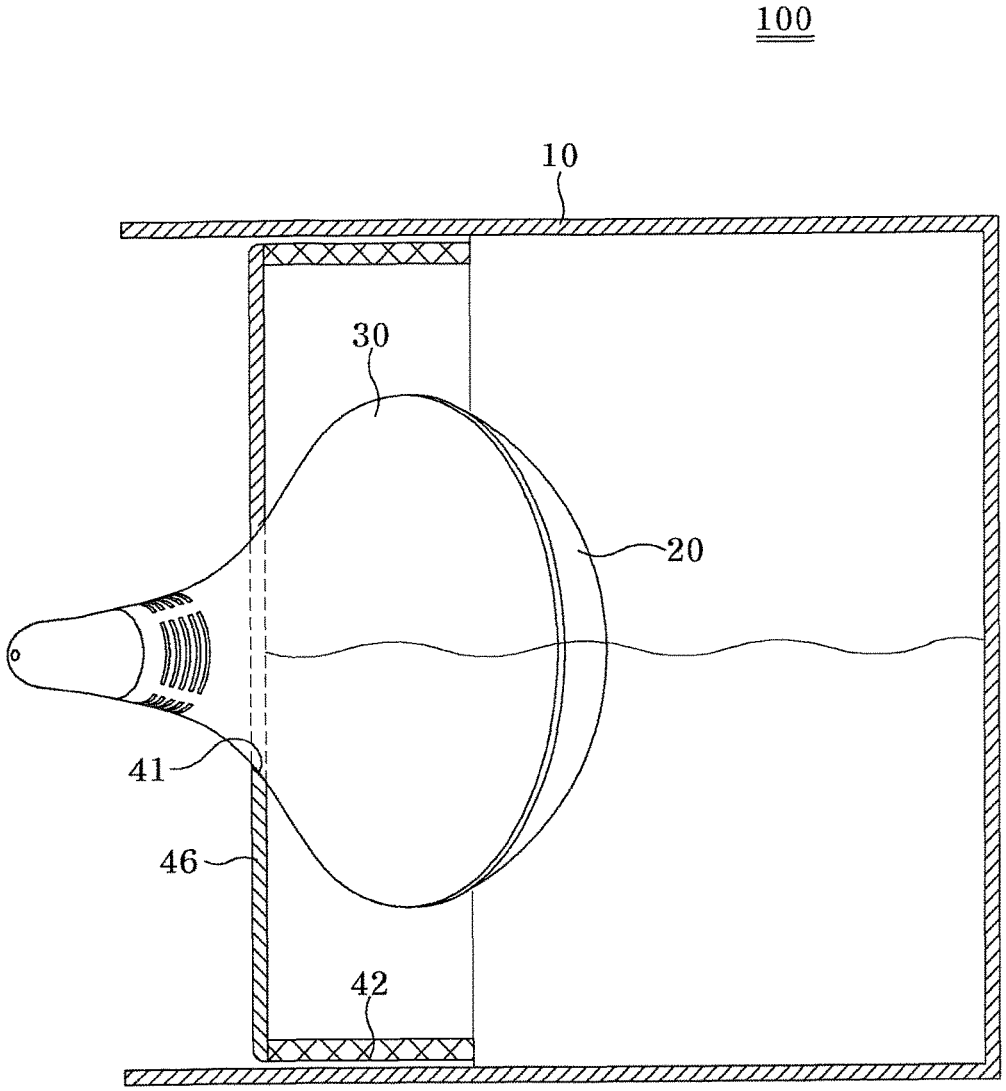
FIG. 9 is a cross-sectional view illustrating a state in which a floating type humidifier falls to one side according to an exemplary embodiment of the present disclosure.

The floating type humidifier 100 according to the exemplary embodiment of the present disclosure, which has such a configuration may prevent the water stored in the water tank 10 from being abruptly discharged to the outside of the water tank 10 by the floating cover 40 even though the water tank 10 falls by the external force as illustrated in FIG. 9.

In addition, when the water tank 10 falls, the humidifier case 30 may block the through-hole 41 while taking an attitude in which the humidifier case 30 is obliquely inclined by a weight of the water.

Accordingly, the water stored in the water tank 10 may be secondarily prevented from being abruptly discharged to the outside through the through-hole 41 by mutual cooperation of the through-hole 41 and the humidifier case 30.

In this case, since the inner surface of the floating cover 40 partitioning the through-hole 41 has the round shape as illustrated in FIG. 6, the outer surface of the humidifier case 30 may be minimized from being damaged due to hitting with the inner surface of the floating cover 40.

For reference, as illustrated in FIG. 8, the rubber made packing member 45 is provided on the inner surface of the cover 40 partitioning the through-hole 41 to minimize shock generated when the outer surface of the humidifier case 40 and the inner surface of the floating cover 40 partitioning the through-hole 41 hit each other and prevent the water from being discharged through a gap between the through-hole 41 and the outer surface of the humidifier case 40 when the water tank 10 falls by the external force.

The detailed exemplary embodiments of the present disclosure have been described up to now, but various modifications can be made without departing from the scope of the present disclosure.

Therefore, the scope of the present disclosure should not be limited to the exemplary embodiment and should be defined by the appended claims and equivalents to the appended claims.

What is claimed is:

1. A floating type humidifier comprising:

a water tank having a shape in which the top is opened;

a floating body which has a water inflow hole through which water stored in the water tank flows and a space part formed therein and floats in the water stored in the water tank;

a humidifier case detachably coupled to the floating body; and a floating cover covering the opened top of the water tank, having a through-hole into which the top of the humidifier case is inserted to be exposed to the outside, and inserted into the water tank to float in the water stored in the water tank.

2. The floating type humidifier of claim 1, wherein the floating cover includes a plate covering the opened top of the water tank, and a protrusion provided on the bottom of the plate, and the protrusion floats in the water stored in the water tank.

3. The floating type humidifier of claim 1, wherein the humidifier case has a shape in which an outer diameter gradually decreases from the bottom to the top and the top is inserted into the through-hole with a gap.

4. The floating type humidifier of claim 1, wherein the inner surface of the floating cover partitioning the through-hole is rounded so as to surface-contact to correspond to the outer surface of the top of the humidifier case.

5. The floating type humidifier of claim 1, wherein a packing member is provided on the inner surface of the floating cover partitioning the through-hole.

6. The floating type humidifier of claim 1, wherein a handle is provided on the floating cover.

7. The floating type humidifier of claim 2, wherein the protrusion of the floating cover is made of any one of a foaming molding object which can float in the water and a rubber material.

8. The floating type humidifier of claim 1, wherein an ultrasonic vibrator is inserted into the water inflow hole of the floating body to generate the water which flows from the water tank as water particles or vapor.

9. The floating type humidifier of claim 8, wherein a guide pipe that guides the water particles or vapor generated by the ultrasonic vibrator to the outside and having a guide hole formed on one side surface is coupled to the top of the water inflow hole of the floating body.

10. The floating type humidifier of claim 1, wherein a cap for controlling an emission amount and an emission direction of the water particles or vapor is provided on the top of the humidifier case, and an emission hole through which the water particles or vapor is discharged is formed at the cap.

11. The floating type humidifier of claim 1, wherein a water injection hole is formed on the cover and a plug is detachably coupled to the water injection hole.

* * * * *